US005694704A

United States Patent [19]

Kasbrick

[11] Patent Number: 5,694,704

[45] Date of Patent: Dec. 9, 1997

[54] REMOVABLE SHOE COVERING

[76] Inventor: Jerome J. Kasbrick, 5270 Eastbrook, Shelby Township, Mich. 48316

[21] Appl. No.: 621,849

[22] Filed: Mar. 25, 1996

Related U.S. Application Data

[63] Continuation-in-part of Ser. No. 368,953, Jan. 5, 1995, abandoned.

[51] Int. Cl.[6] ..... A43B 3/10; A43C 15/00

[52] U.S. Cl. ..... 36/7.6; 36/59 R

[58] Field of Search ..... 36/59 C, 59 R, 36/62, 7.6, 7.7, 9 A, 9 R

[56] References Cited

U.S. PATENT DOCUMENTS

| | | | |
|---|---|---|---|
| 988,159 | 3/1911 | Wiltse . | |
| 2,408,162 | 9/1946 | Porcelli | 36/59 |
| 2,714,771 | 9/1955 | Olfene | 36/9 A |
| 3,009,269 | 11/1961 | Folk | 36/7.5 |
| 3,040,451 | 6/1962 | Hilkemeyer | 36/11 X |
| 3,337,770 | 8/1967 | Saraceni et al. | 317/2 |
| 3,358,188 | 12/1967 | Zimmon | 317/2 |
| 3,399,470 | 9/1968 | Schofield | 36/7.1 |
| 3,402,323 | 9/1968 | Longstreth | 317/2 |
| 3,422,550 | 1/1969 | Robinson | 36/7.1 |
| 3,561,140 | 2/1971 | Ludwig | 36/59 |
| 3,693,269 | 9/1972 | Guarrera | 36/15 |
| 3,898,750 | 8/1975 | Epstein | 36/49 |
| 3,903,620 | 9/1975 | Gillet | 36/25 |
| 4,019,265 | 4/1977 | Epstein | 36/7.1 K |
| 4,301,604 | 11/1981 | Hamilton | 36/130 |
| 4,616,429 | 10/1986 | Alcala | 36/7.2 |
| 4,702,021 | 10/1987 | Cameron | 36/62 |
| 4,825,563 | 5/1989 | Strongwater | 36/73 |
| 4,847,934 | 7/1989 | Weber | 12/142 |
| 4,896,439 | 1/1990 | Morgan | 36/7.5 |
| 4,918,839 | 4/1990 | Brandon | 36/7.1 |
| 4,926,568 | 5/1990 | Coffman | 36/1.5 |
| 4,967,491 | 11/1990 | Plotkin | 36/7.1 |
| 5,056,240 | 10/1991 | Sherrill | 36/7.3 |
| 5,485,687 | 1/1996 | Rohde | 36/62 |

FOREIGN PATENT DOCUMENTS

| | | | |
|---|---|---|---|
| 2039611 | 10/1992 | Canada | 36/62 |
| 6219482 | 8/1994 | Japan | 36/136 |
| 10731 | 5/1906 | United Kingdom | 36/7.5 |

*Primary Examiner*—B. Dayoan

*Attorney, Agent, or Firm*—Gifford, Krass, Groh, Sprinkle, Patmore, Anderson & Citkowski, P.C.

[57] ABSTRACT

A removable shoe covering is disclosed which is formed from a flexible sheet having a central section and two outwardly extending side portions. The central portion has a cross-sectional area at least large enough to cover the bottom of the shoe while the side portions of the sheet extend upwardly along opposite sides of the shoe and overlap each other at the top of the shoe. A pressure sensitive adhesive is applied to one side of the sheet for removably adhering the sheet to the shoe.

3 Claims, 3 Drawing Sheets

REMOVABLE SHOE COVERING

CROSS REFERENCE TO RELATED APPLICATIONS

This is a continuation in part of U.S. patent application Ser. No. 08/368,953, filed Jan. 5, 1995 now abandoned , entitled Removable Shoe Covering.

BACKGROUND OF THE INVENTION

1. Field of the Invention

The background of the invention relates to a covering for a shoe.

2. Description of the Prior Art

Paint spray booths are used in numerous different industries for painting objects of one sort or the other. For example, such spray booths are conventionally used in the automotive industry for painting the car bodies.

In such paint spray booths, excess paint invariably collects on the floor. Workmen working within the paint spray booth then step on the paint and track the paint out of the spray booth and into the factory shop area. This is not only unsightly, but also causes a safety hazardous condition.

SUMMARY OF THE PRESENT INVENTION

The present invention provides a device which overcomes the above-mentioned disadvantages of the previously known paint spray booth.

In brief, the present invention provides a removable shoe covering comprising a flexible sheet having a central portion and two outwardly extending side portions. The central portion has a cross-sectional area at least large enough to cover the bottom of the shoe and, in doing so, the side portions extend upwardly along opposite sides of the shoe and overlap each other on top of the shoe.

In order to secure the sheet to the shoe, one side of the sheet is covered with a pressure sensitive adhesive. This pressure sensitive adhesive adheres the central portion of the sheet to the bottom of the shoe as well as the side portions of the sheet to the side of the shoe and to each other at the top of the shoe.

In the preferred form of the invention, the flexible sheet is constructed from a one piece sheet of paper. Additionally, a base strap includes an arcuate side which fits in front of the upper arch of the foot.

BRIEF DESCRIPTION OF THE DRAWING

A better understanding of the present invention will be had upon reference to the following detailed description when read in conjunction with the accompanying drawing, wherein like reference characters refer to like parts throughout the several views and in which.

DETAILED DESCRIPTION OF PREFERRED EMBODIMENTS OF THE PRESENT INVENTION

Figure 1:
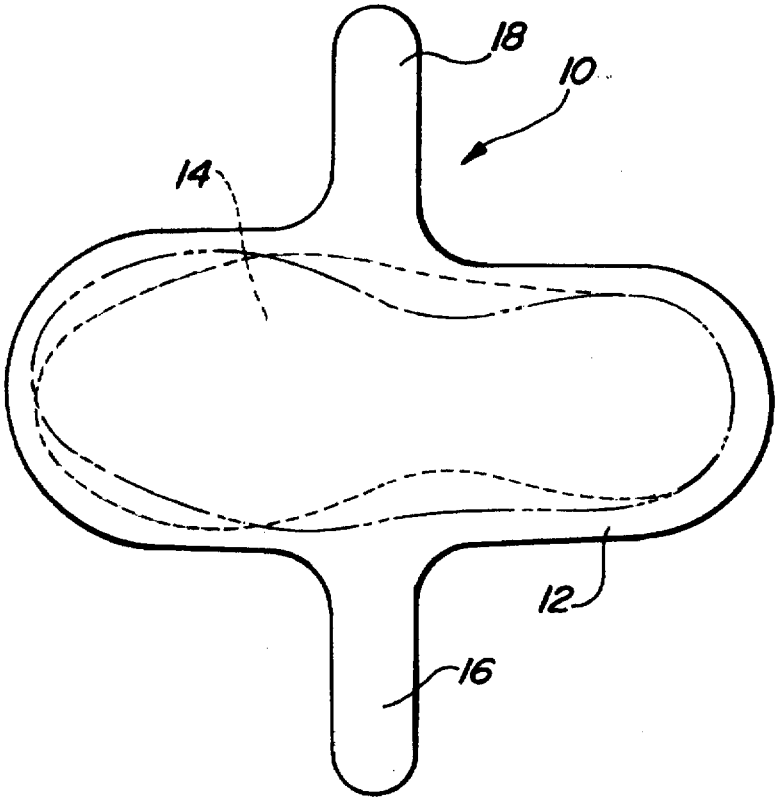
FIG. 1 is a plan view illustrating a preferred embodiment of the present invention.

With reference first to FIG. 1, a preferred embodiment of the removable shoe covering 10 of the present invention is there shown and comprises a flexible sheet 12 having a central portion 14 and two outwardly extending and elongated side portions 16 and 18. The shoe covering 10 is preferably of a one-piece construction and comprises a sheet of vinyl.

Figure 2:
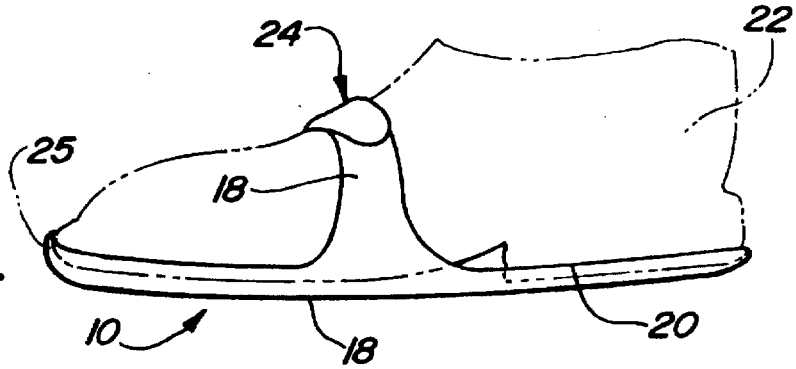
FIG. 2 is an elevational view illustrating the preferred embodiment of the invention attached to a shoe.

With reference now to FIGS. 1 and 2, the central portion 14 of the sheet 12 has a cross-sectional area sufficiently large to cover the bottom 20 of a shoe 22. With the central portion 14 positioned across the bottom 20 of the shoe 22, the side portions 16 and 18 extend upwardly along opposite sides of the shoe 22 and preferably overlap at the top of the shoe 22 as shown at 24. It will, of course, be understood that different sizes for the sheet 12 can accommodate different sizes of shoes 22. Any excess of the central portion 14 of the sheet 12, however, can simply be wrapped upwardly around the bottom of the shoe 22 as shown at 25.

Figure 3:
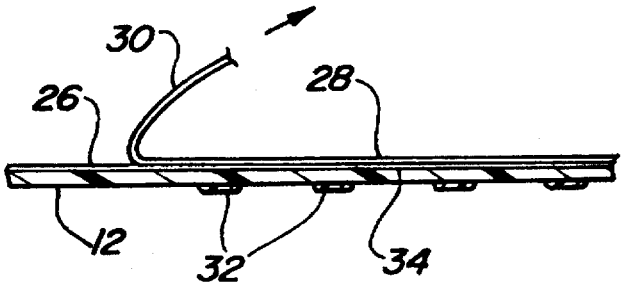
FIG. 3 is a fragmentary side view of the preferred embodiment of the present invention.

With reference now to FIGS. 2 and 3, in order to secure the sheet 12 to the shoe 22, the sheet 12 includes a coating 26 of pressure sensitive adhesive along one side 28. This coating 26, prior to use, is covered by a removable backing 30 (FIG. 3).

In order to secure the sheet 12 to the shoe 22, the backing 30 is first removed from the sheet. Thereafter, the central portion 14 of the sheet 12 is adhesively secured to the bottom 20 of the shoe 22. The side portion 16 and 18 of the sheet 12 are then wrapped upwardly about opposite sides of the shoe 22 so that one side 16 or 18 overlaps and is adhesively secured to the other side 18 or 16 along the top 24 of the shoe 22. In doing so, the entire bottom plane of the shoe 22 is covered by the sheet 12 and thus protected from any paint or other material on the floor.

With reference now to FIG. 3, friction buttons 32 are preferably provided at spaced intervals along the side 34 of the sheet 12 opposite from the adhesive coating 26. These buttons 32, which are made of an elastomeric and/or gritty material, enhance the frictional grip between the sheets and ground support surface to minimize slippage. Alternatively, the entire lower side 34 of the sheet 12 or a pattern on the lower side 34 of the sheet 12 is coated with a friction enhancing material to minimize slippage.

Although any conventional method may be used to adhere the friction material to the side 34 of the sheet 12, preferably the lower side 34 of the sheet is coated with a settable material, such as paint. The friction material is then applied in a pattern to the settable material so that, upon setting of the settable material, the friction material is adhered to the sheet 12.

In practice, once the workman is ready to exit from the paint spray booth or other working area, the shoe covering 10 can be simply and rapidly removed from the shoe 22 by simply pulling it from the shoe 22 and disposing of the covering 10 in any appropriate manner.

Figure 4:
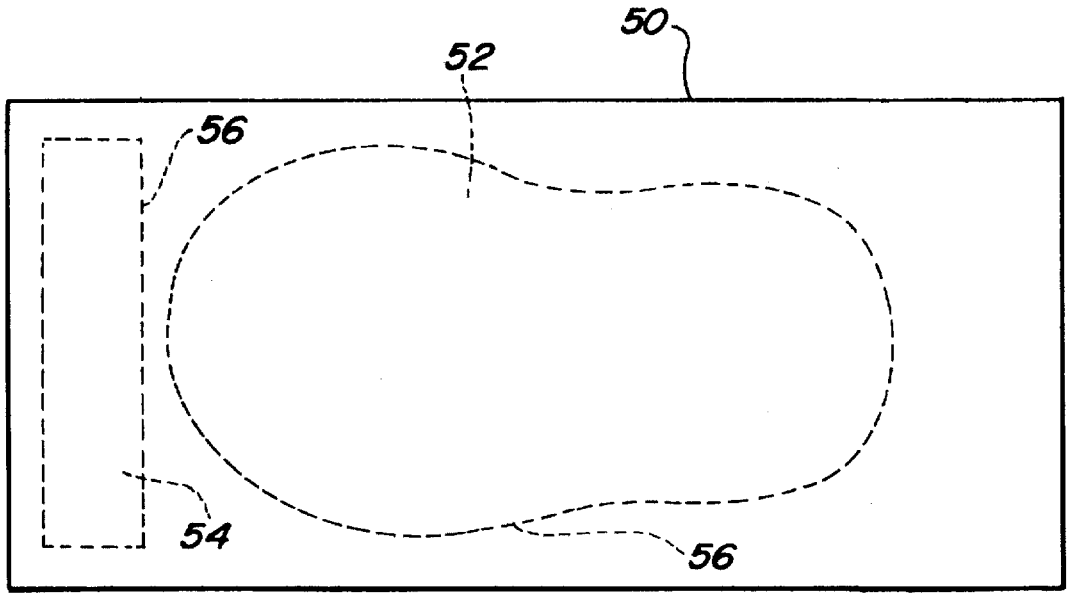
FIG. 4 is a plan view illustrating a second preferred embodiment of the invention.
Figure 5:
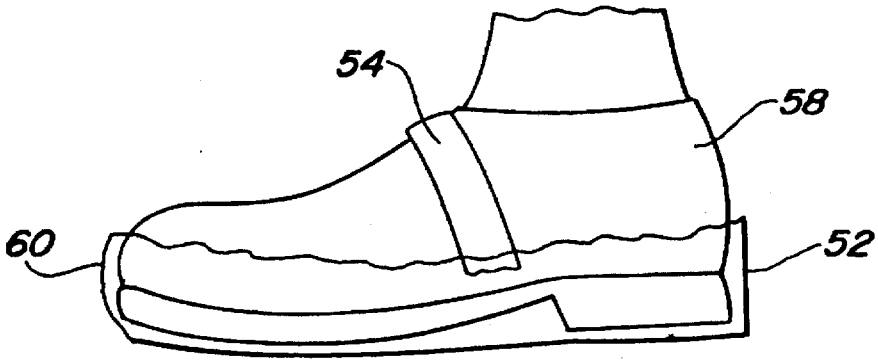
FIG. 5 is a side view of the second preferred embodiment of the invention.

With reference now to FIGS. 4 and 5, a second preferred embodiment of the invention is there shown in which a generally rectangular sheet 50 has a sole portion 52 in the shape of a sole of a shoe and an elongated and generally rectangular strap 54 perforated at 56 in the sheet. Thus, the sole portion 52 and strap 54 are easily removed from the sheet 50. The sheet 50 is preferably a vinyl sheet with a pressure sensitive adhesive on one side.

As best shown in FIG. 5, with the sole portion 52 and strap 54 removed from the sheet 50 along the perforations 56, the sole portion 52 is adhesively secured to the bottom of a shoe 58. The strap 52 is then adhesively secured around the top of the shoe 58 and to opposite sides of the sole portion 52 to firmly, but removably secure the sole portion 52 to the shoe 58. Furthermore, the sole portion 52 is preferably larger in size than the bottom of the shoe 58 so that sole portion 52 wraps upwardly around and protects the sides of the shoe as shown at 60.

One problem with the rectangular strap 54 illustrated in FIGS. 4 and 5 is that the strap 54 extends around the upper arch portion 76 of the shoe 22 once attached to the shoe 22. In some cases the normal flexing of the shoe 22 can cause the strap to loosen.

Figure 7:
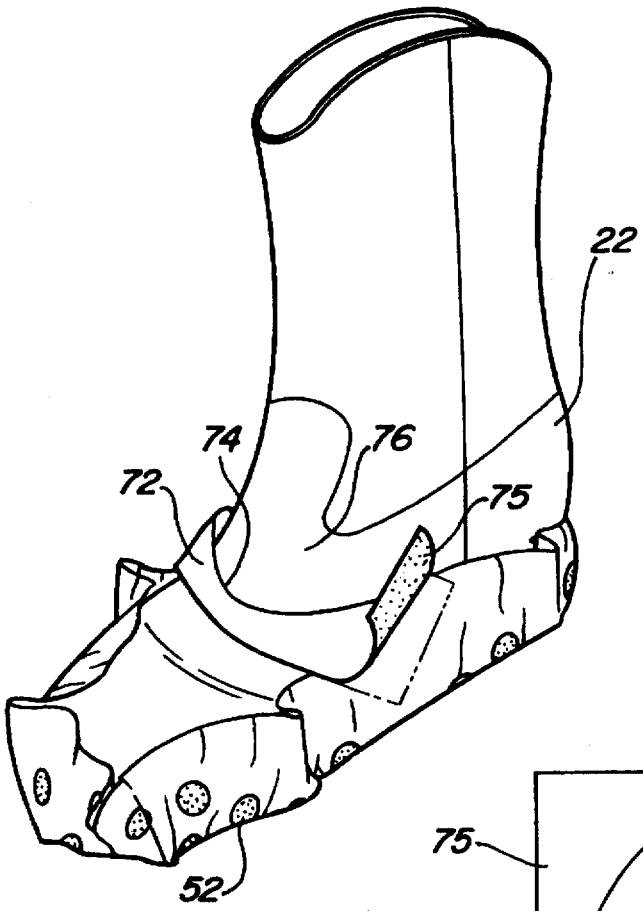
FIG. 7 is an elevational area of the third preferred embodiment attached to a shoe.
Figure 6:
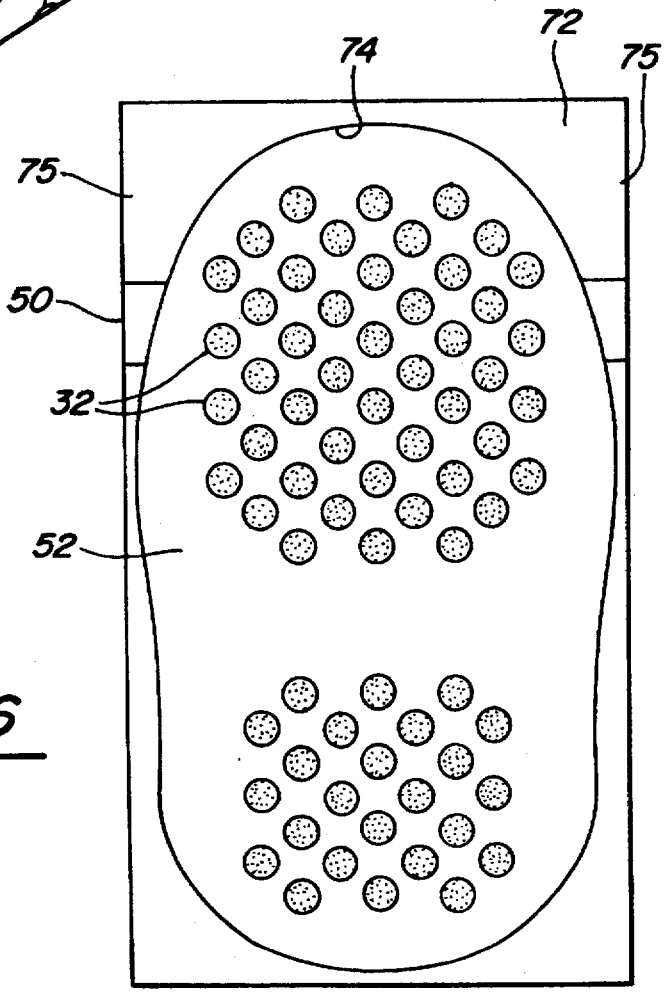
FIG. 6 is a top plan view of a third preferred embodiment of the invention.

With reference now to FIGS. 6 and 7, an improved strap 72 is provided which is cut from the sheet 50 along with the sole portion 52. The strap 72 includes a curvilinear edge 74 which also forms the outline for the front or rear of the sole portion 52. The strap 72 also has two connecting portions 75 at its ends.

As best shown in FIG. 7, the sole portion 52 is removed from its backing strip and attached to the bottom of the shoe 22 in the previously described fashion so that the outer edge of the sole portion 52 extends upwardly along the sides of the shoe 22. The strap 72 is also removed from its backing sheet and attached across the top of the shoe 22 so that its curved edge 74 faces rearwardly.

In doing so, the strap 72 extends over the top of the shoe at a position spaced forwardly of the upper arch portion 76 of the shoe 22 so that the strap 72 is not subjected to stretching during normal flexing of the shoe 22. As such, the strap 72 remains in position in the desired fashion.

Additionally, the buttons 32 preferably comprise stone grit intermixed with ink. The mixture is then applied to the sheet through a silk screening process and then cured by ultraviolet light.

From the foregoing it can be seen that the present invention provides a simple, inexpensive and yet totally effective means for protecting a workman's shoe against paint or other materials on a work floor.

Having described my invention, many modifications may be made thereto without deviation from the spirit of the invention as defined by the scope of the appended claims.

I claim:

1. A removable shoe covering for a shoe having a bottom, sides and an upper instep portion, said covering comprising:

a flexible sheet having a sole portion with a shape and area larger than the shape and area of the bottom of the shoe, at least one elongated strap having two ends and dimensioned to extend over the upper instep portion and between opposite sides of the flexible sheet sole portion, a pressure sensitive adhesive applied continuously to a first side of said sheet for removably adhering said sheet to the shoe bottom, wherein, with said first side of said sheet adhered to the bottom of the shoe, portions of the sheet extend upwardly from the bottom of the shoe and along the sides of the shoe, said portions adhering to the sides of the shoes, and a gritty material applied substantially continuously to a second side of said sheet, wherein said strap has an arcuate edge which faces rearwardly of the shoe so that, with said strip positioned across the upper instep portion of the shoe so that said ends of said strap are in engagement with said portions of said sheet, said strap is positioned forwardly of the upper arch portion of the shoe and so that said arcuate edge rests against said upper instep portion whereupon said ends of said strap engage said portions of said sheet at a rear half of said sheet.

2. The invention as defined in claim 1 wherein said flexible sheet is made of vinyl.

3. The invention as defined in claim 1 and comprising a backer covering for said first side of said flexible sheet, said backer covering extending over said pressure sensitive adhesive and removed from said sheet prior to adhering said sheet to the shoe.

* * * * *